US007681672B2

(12) United States Patent
Spalletta

(10) Patent No.: US 7,681,672 B2
(45) Date of Patent: Mar. 23, 2010

(54) CRYOGENIC PULSEJET AND METHOD OF USE

(75) Inventor: Robert A. Spalletta, Scranton, PA (US)

(73) Assignee: The University of Scranton, Scranton, PA (US)

( * ) Notice: Subject to any disclaimer, the term of this patent is extended or adjusted under 35 U.S.C. 154(b) by 257 days.

(21) Appl. No.: 11/886,373

(22) PCT Filed: Mar. 23, 2006

(86) PCT No.: PCT/US2006/011093

§ 371 (c)(1),
(2), (4) Date: Sep. 15, 2007

(87) PCT Pub. No.: WO2006/105014

PCT Pub. Date: Oct. 5, 2006

(65) Prior Publication Data

US 2009/0050367 A1 Feb. 26, 2009

Related U.S. Application Data

(60) Provisional application No. 60/666,970, filed on Mar. 31, 2005.

(51) Int. Cl.

| | |
|---|---|
| ***E21B 7/18*** | (2006.01) |
| ***E21B 43/114*** | (2006.01) |
| ***C09K 8/02*** | (2006.01) |
| ***E21B 36/00*** | (2006.01) |
| ***E21B 7/00*** | (2006.01) |

(52) U.S. Cl. ..... 175/424; 175/17

(58) Field of Classification Search ..... 175/424, 175/17

See application file for complete search history.

(56) References Cited

U.S. PATENT DOCUMENTS

| | | | | |
|---|---|---|---|---|
| 2,621,022 | A * | 12/1952 | Bardill | 175/17 |
| 3,424,254 | A * | 1/1969 | Huff | 175/17 |
| 3,482,640 | A * | 12/1969 | Browning | 175/14 |
| 3,650,337 | A * | 3/1972 | Andrews et al. | 175/17 |
| 4,516,878 | A * | 5/1985 | Rebhan | 405/130 |

* cited by examiner

*Primary Examiner*—Jennifer H Gay
*Assistant Examiner*—Cathleen R Hutchins
(74) *Attorney, Agent, or Firm*—Charles L. Riddle; Riddle Patent Law

(57) ABSTRACT

A cryogenic system is described for boring a small-diameter hole through various materials including rock, soil and stone. It employs a valveless technique in a borehead [3000] where cryogenic fluid [7] fills at least one pulsejet [3100] which has proximal [3001] and distal [3003] ends. The cryogenic fluid [7] is frozen into a plug [8] near the distal end [3003], acting as a valve. Cryogenic fluid [7] just distal to the frozen plug [8] is rapidly heated by thermal units [3510, 3530] causing it to become a rapidly-expanding gas bubble. The rapidly-expanding gas bubble forces any liquid [7] distal to the expanding gas out of the distal end [3003] of each pulsejet [3100] causing it to impact the material [I]. Rapidly repeating this process causes the system to bore a hole through the material [I].

19 Claims, 5 Drawing Sheets

CRYOGENIC PULSEJET AND METHOD OF USE

CROSS REFERENCE TO RELATED APPLICATIONS

The present application claims priority from U.S. Provisional Patent Application "The Archimedes Javelin" Ser. No. 60/666,970 filed Mar. 31, 2005 by Wojciech Andrew Berger, Robert A. Spalletta, Jerry A. Carter, Marian Mazurkiewicz, Richard M. Pell, Christopher Davey. The present Patent Application is also related to U.S. patent application Ser. No. 11/886,374 (U.S. Pat. No. 7,584,807) entitled "System for Rapidly Boring Through Materials" and U.S. patent application Ser. No. 11/886,372 "Multiple Pulsejet Boring Device" both filed on Sep. 15, 2007 by Wojciech Andrew Berger, Robert A. Spalletta, Jerry A. Carter, Richard M. Pell, Marian Mazurkiewicz. All above applications are hereby incorporated by reference as if set forth in its entirety herein.

BACKGROUND OF THE INVENTION

1. Field of the Invention

The present invention relates to a valveless cryogenic system for boring through materials.

2. Discussion of Related Art

There currently are prior art boring devices and other machinery which are designed to drill through materials, such as rock and earth. Many of these employ mechanical rotary drills. Which require strong structures to anchor the drill and counter the rotational forces.

Other drills exist which employ forcing a high pressure liquid at the material to bore through it. These require a great deal of pressure to be passed to the cutting end of the drill.

Since many of the materials being bored are brittle, prior art cryogenic drills have been used. These use high pressure (but not as high as the liquid cutting drills) to force cryogenic liquid at a brittle object, freezing it and impacting it with the cryogenic liquid. The frozen material is more brittle and fractures when impacted by the cryogenic liquid.

Since these apply high pressure to the cutting tip, which may be some distance away, it has structural requirements not only to contain the pressure and pass it to the tip, but also to keep the cryogen cool. These tend to make the drill bulky and hard to manage.

In addition, these require a valved system to intermittently allow and stop the fluid to create a stream of pulsed liquid slugs which impact the target.

These valves are acting under extreme conditions and tend to freeze and fail.

Currently, there is a need for a low pressure drilling device which is more effective than prior art devices.

SUMMARY OF THE INVENTION

One embodiment of the present invention is a cryogenic rapid boring system for rapidly boring a hole in a material (1) comprising:

a) A borehead (3000) having at least one pulsejet (3100) with a proximal end (3001) and a distal end (3003) located adjacent said material (1) intended to be bored;

b) A cryogen supply unit (1010) for providing a cryogenic liquid (7) to fill the pulsejet (3100);

c) The pulsejet (3100) having an expansion section (3120) located adjacent to the distal end (3003);

d) The tube having a freeze section (3110) located just proximal to the expansion section (3120);

e) At least one thermal unit (3410) capable of freezing cryogenic liquid (7) into a plug (8) and capable of melting frozen plug (8) located adjacent to the freeze section (3110);

f) At least one thermal unit (3510) capable of vaporizing cryogenic liquid (7) into a gas, and capable of cooling the expansion section (3120);

g) A controller (1020) coupled to the cryogen supply unit (1010), the thermal units (3410, 3430, 3510, 3530), operating to activate:

i. the cryogen supply unit (1010) to fill the pulsejet (3100) with cryogenic liquid (7);

ii. thermal units (3410, 3430) to freeze a plug (8) at the freeze section (3110);

iii. thermal units (3510, 3530) to rapidly vaporize cryogenic liquid (7), into a gas just distal to the frozen plug (8) thereby causing it to force cryogenic liquid (7) distal to the gas, out of the distal end (3003) of pulsejet (3100) at a high velocity impacting said material (1) thereby 'firing' the pulsejet (3100).

The present invention may also be embodied as a method of boring through solid material (1) with a cryogenic liquid (7) comprising the steps of:

a. providing a borehead (3000) having at least one pulsejet (3100) capable of holding a liquid, having a distal end (3003) and an opposite proximal end, the distal end being positioned near, and pointing toward said material;

b. providing cryogenic liquid (7) to the proximal end of the pulsejet (3100);

c. freezing the cryogenic liquid (7) near the distal end of the pulsejet (3100) into a plug (8) at a location such that there is cryogenic liquid (7) distal to the plug (8);

d. rapidly heating the cryogenic liquid (7) distal to the plug (8) causing it to be converted into rapidly-expanding gas (9) rapidly forcing the cryogenic liquid (7) distal to the gas (8) out of the distal end of the pulsejet (3100) as a slug (10) which impacts said material (1);

e. repeating steps "b"-"d" to cause multiple slugs (10) to be forced out of the pulsejet (3100) thereby boring a hole through said material (1).

OBJECTS OF THE INVENTION

It is an object of the present invention to provide a system which bores through materials more efficiently than the prior art devices.

It is another object of the present invention to provide a simpler system for boring through materials than the prior art devices.

It is another object of the present invention to provide a more reliable system for boring through materials than the prior art devices.

It is another object of the present invention to provide a valveless cryogenic system for boring through materials.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
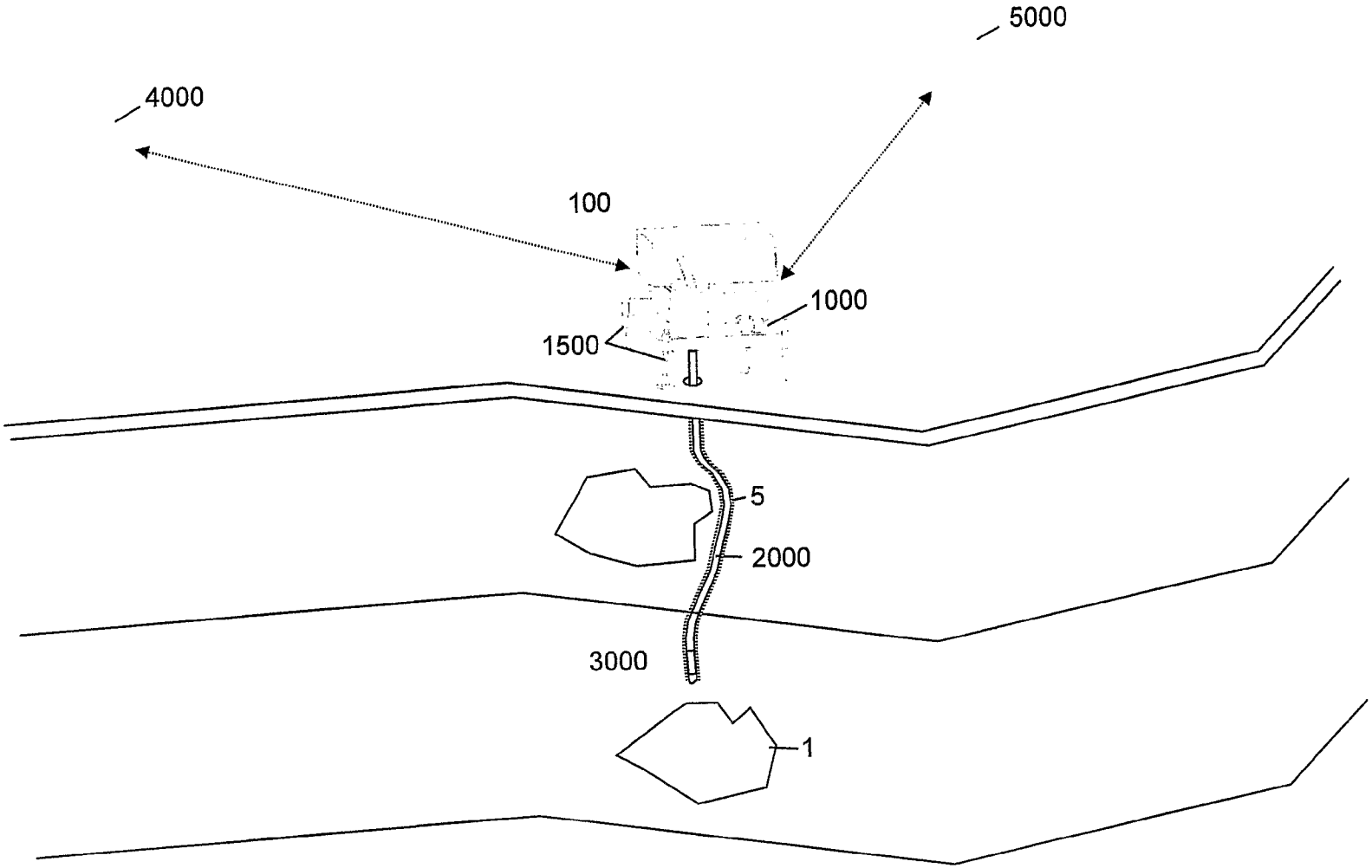
FIG. 1 is a perspective view of a cryogenic boring system according to one embodiment of the present invention.

One embodiment of the present invention is shown in perspective view in FIG. 1. A number of ground units 100, 4000, 5000 are delivered to the ground. Unit 100 is positioned just above a target 1 which may be an underground void or object. Ground unit 100 may be delivered there by a number of different conventional known methods including an air-drop for inaccessible locations.

Ground unit 100 employs a platform subsystem 1000 having retention and orientation devices 1500 which secure ground unit 100 to the ground and tilts platform 1000 to an optimum orientation for boring to target 1. Platform subsystem 1000 is designed to hold, store and carry all the equipment during deployment, initiate boring of an access hole, hold materials to be used in a fuel reservoir, stabilize ground unit 100 for boring, and communicate with other units.

A boring subsystem 3000 bores down through the ground toward target 1, creating an access hole 5. Boring subsystem 3000 is designed to force the excavated materials out of the access hole 5 and to the surface.

Boring subsystem 3000 is connected to platform subsystem 1000 by an umbilical subsystem 2000.

Umbilical subsystem 2000 connects the Platform 1000 and Boring 3000 subsystems. It acts to pass materials, electricity, and control signals between platform 1000 and boring 3000 subsystems.

Umbilical subsystem 2000 also employs mechanical actuators to absorb much of the forces produced during boring, as well as for steering and advancing umbilical subsystem 2000 and boring 3000 subsystems deeper into the access hole 5.

The boring subsystem 3000 employs pulsejets shown in greater detail in FIGS. 2*a*-2*f*.

FIGS. 2*a*-2*f* are a time sequence of enlarged views of a pulsejet 3100 of the cryogenic borehead (3000 of FIG. 1), showing the operation of the pulsejet 3100.

Figure 2C:
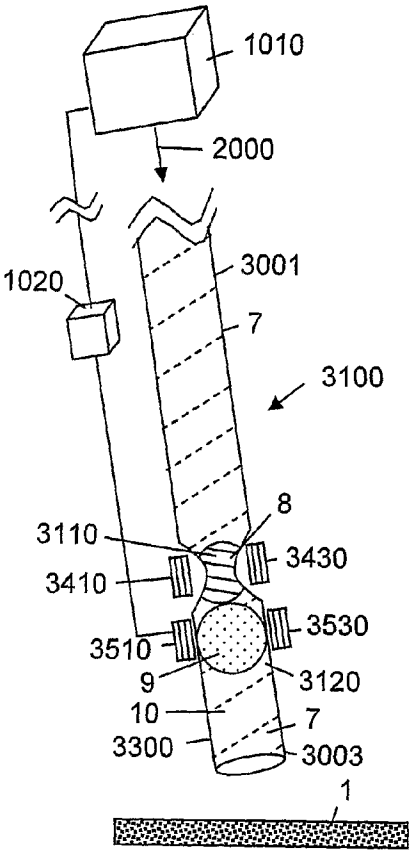
FIGS. 2*a*-2*f* are enlarged views of a portion of the cryogenic boring device of FIG. 1, showing the operation of the pulsejets.
Figure 2B:
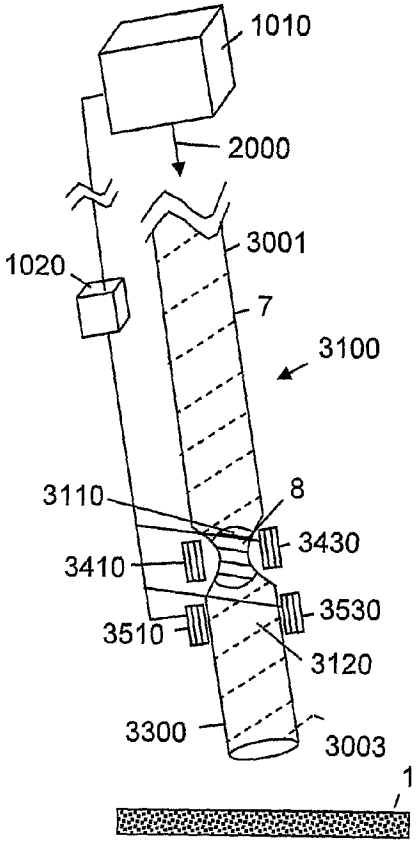
Figure 2A:
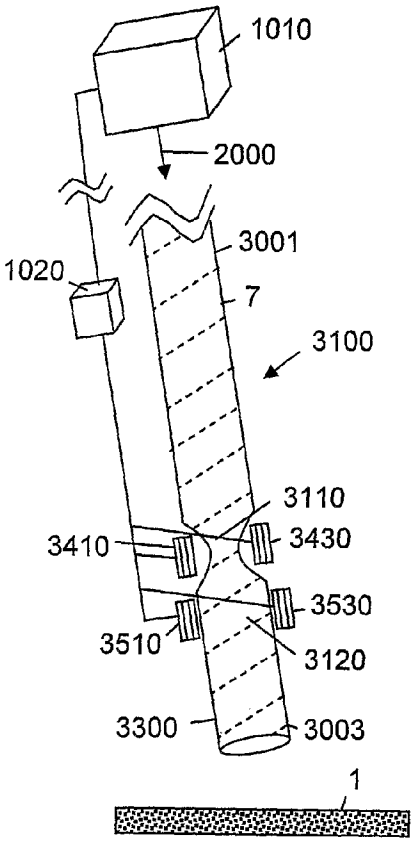

In FIG. 2*a*, a pulsejet 3100 is shown in an enlarged view. A cryogenic fluid 7 passes through umbilical 2000 to pulsejet 3100. Pulsejet 3100 employs a freezing section 3110 near the distal end of pulsejet 3100. Just distal to the freezing section 3110 is an expansion section 3120. Just distal to the expansion section is an exit section 3300.

In FIG. 2*a*, cryogenic fluid 7 has passed down umbilical 2000 and has filled freeze section 3110, expansion section 3120 and exit section 3300. Adjacent to freeze section 3110 is at least one thermal unit 3410, 3430. In FIG. 2*a* both thermal units 3410, 3430 are inactive. Adjacent to expansion section 3120 is at least one thermal unit 3510, 3530. In FIG. 2*a* both thermal units 3510, 3530 are inactive.

FIG. 2*b* shows the system at some time after that of FIG. 2*a*, thermal units 3410, 3430 are activated to cause cryogenic fluid 7 in freeze section 3110 to solidify. Preferably, freeze section 3110 is narrower than the remainder of the system allowing quick freezing. At this time thermal units 3510, 3530 are inactive.

In FIG. 2*c*, thermal units 3510, 3530 are activated to provide heat to the cryogenic fluid 7 in expansion region 3120. Fluid 7 rapidly changes into a gas producing a rapidly-expanding gas bubble 9 pushing fluid 7 in exit section 3300 out as a liquid slug 10.

An efficient method of supplying electric energy to thermal units 3410, 3430 first, then to thermal units 3510, 3530 is to use the Peltier effect In the Peltier effect, an electric current of magnitude J across the junction of two different conductors A and R with Peltier coefficients $\Pi_A$ and $\Pi_B$ produces heat at the rate $$\dot{W}-(\Pi_A-\Pi_B)\cdot J$$

The sign of $\dot{W}$ can be positive as well as negative. A negative sign means cooling of the junction. Contrary to Joule heating, the Peltier effect is reversible and depends on the direction of the current. In this effect, thermal units 3410, 3510 are coupled. Thermal units 3430 and 3530 are also coupled. Energy is first provided to thermal units 3410, 3430, then by the Peltier effect, the energy is then passed through thermal units 3510 from 3410; and through thermal unit 3530 from thermal unit 3430.

Figure 2F:
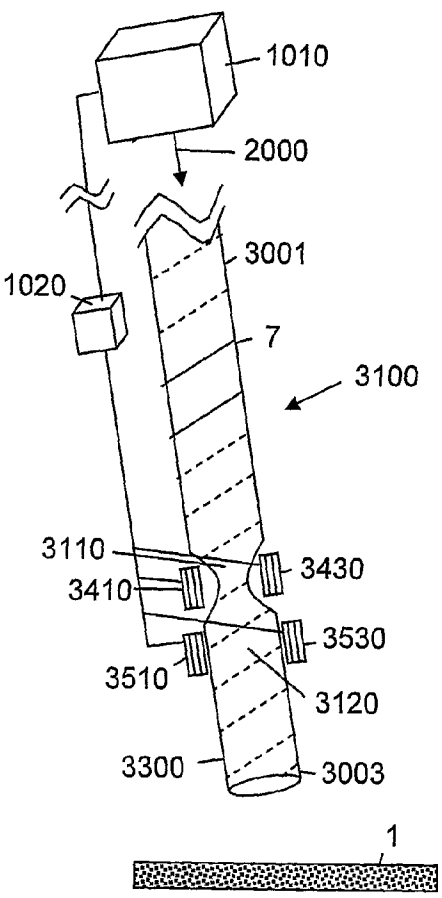
Figure 2E:
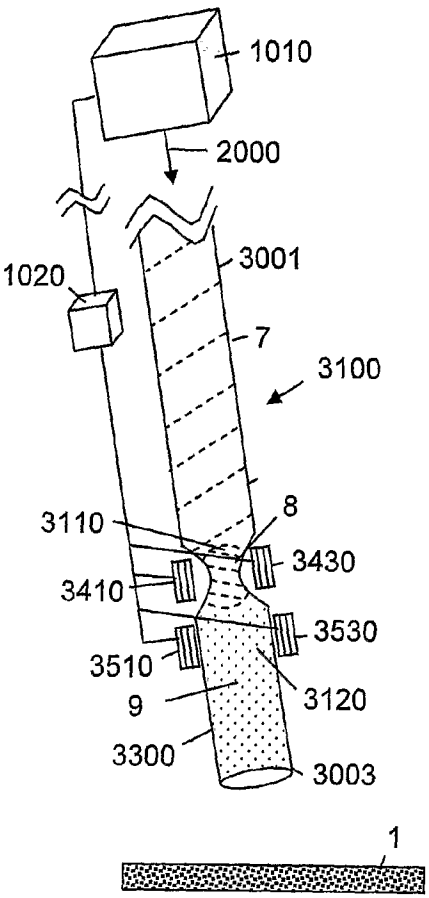
Figure 2D:
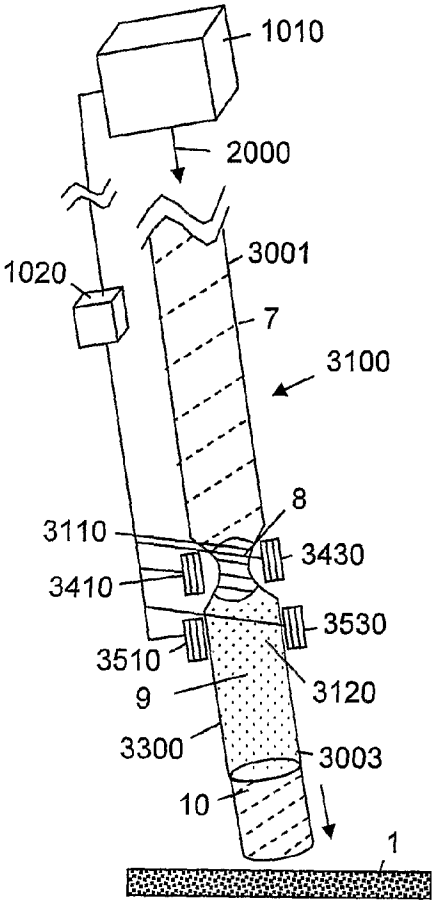

In FIG. 2*d* thermal units 3510, 3530 have stopped providing heat to fluid 7. It can be seen here that expansion section 3120 and exit section 3300 are filled with the gas. The liquid slug 10 has been expelled from the exit section at a high velocity. Slug 10 is typically directed to the material which is intended to be bored. Slug 10 freezes and shatters the frozen material, thereby boring through the material.

In FIG. 2*e* thermal units 3410, 3430 heat frozen plug 8, melting it. At the same time, thermal units 3510, 3530 cool expansion section 3120, getting it ready to receive more cryogenic fluid 7.

In FIG. 2*f*, fluid 7 fills freeze section 3110, expansion section 3120 and exit section 3300, putting the system in the state it was in as shown in FIG. 2*a*. The cycle may now be repeated.

By controlling when thermal units 3410 and 3430 freeze the liquid 7, one can adjust the amount of liquid distal to the plug 8. This thereby adjusts the size of the slug 10.

By controlling how much energy is provided to thermal units 3510 and 3530, one may adjust the intensity in which the pulsejet 3100 is 'fired'.

The present invention may also be viewed as a novel method of boring through a material.

Figure 3:
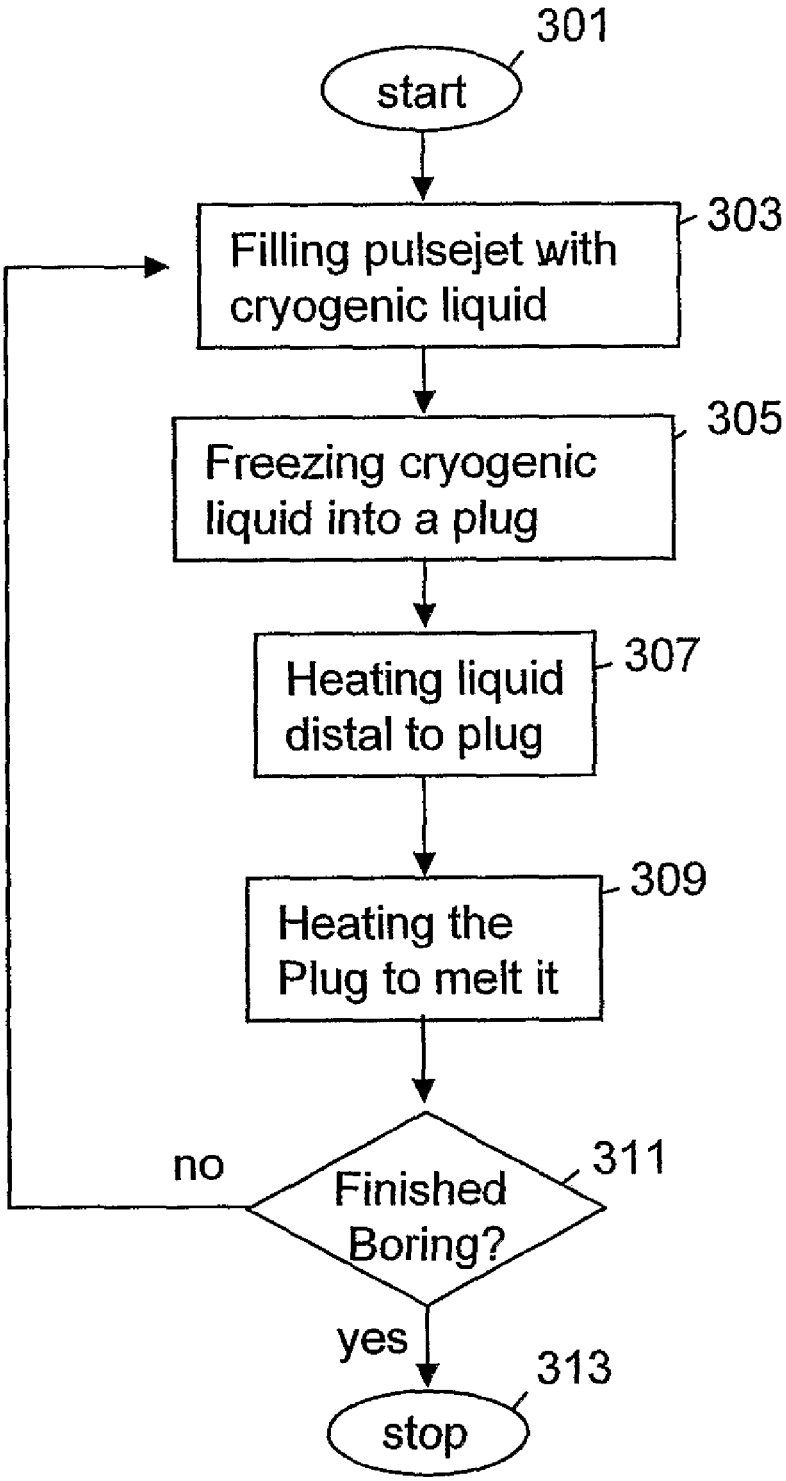
FIG. 3 is a flowchart illustrating the functioning of the present invention.

FIG. 3 is a flowchart illustrating the functioning of the present invention. This invention is a method of drilling through solid materials employing pumping a cryogenic fluid through a pipe into the target material. The process begins at step 301.

In step 303 a tube extending in a proximal direction and a distal direction is filled with cryogenic fluid.

In step 305, at a location within the material, a refrigeration section freezes the cryogen in the pipe into a solid "plug".

The cryogenic liquid near the distal end of the tube is frozen into a plug by applying current to freezing coils. This plug is positioned such that there is cryogenic liquid distal to the plug in the tube. The plug at least partially blocks the tube.

In step 307, the cryogenic liquid distal to the plug is heated, causing a rapidly-expanding gas bubble to form. The rapidly-expanding gas bubble pushes the cryogenic liquid distal to the bubble as a slug out of the end of the distal end of the tube at a high velocity. The frozen cryogen is used as a 'backstop' to bounce against causing the force to cause the liquid to pass outward through the distal end of the tube against the material to be bored.

In step 309, the plug is rapidly heated to melt it allowing cryogenic fluid again to fill the tube.

In step 311 it is determined if the boring has been completed. If boring has been completed ("yes"), then the process stops at step 313.

If not ("no"), then steps 303 through 311 are repeated. Repeating the sequence causes a plurality of slugs to be rapidly forced out of the tube. The repeated slug impacts destroy and cut through the target material, thereby boring a hole through the material.

The tip may also employ small reverse nozzles which point away from the material to be bored. Some of the escaping gases fire through these reverse nozzles propelling the tip further into the material to be bored.

Figure 4:
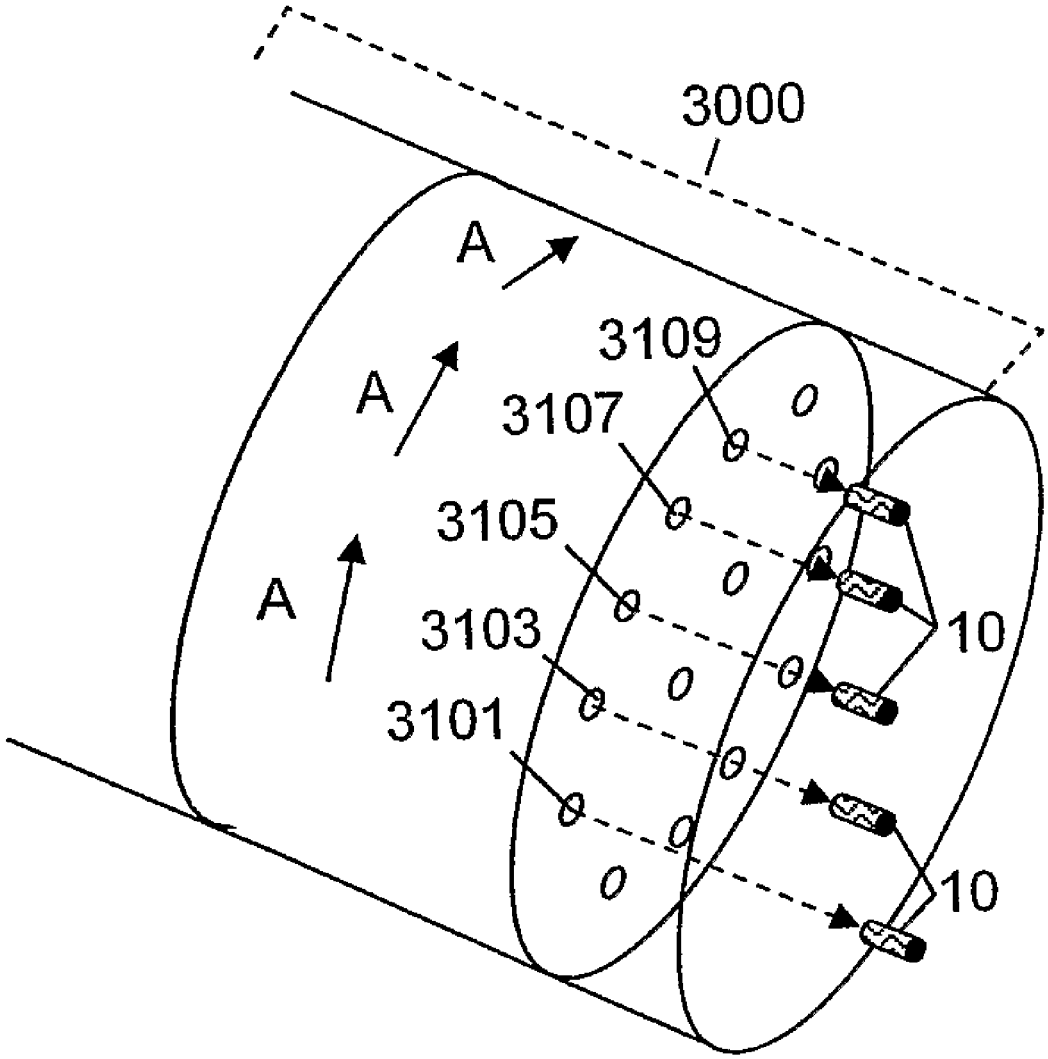
FIG. 4 shows an embodiment of the present invention employing multiple cryogenic pulsejets in a single borehead.

FIG. 4 shows an embodiment of the present invention employing multiple cryogenic pulsejets in a single borehead. The distal ends of several pulsejets 3101, 3103, 3105, 3107 and 3109 are shown. These pulsejets may be fired in different sequences and intensities to simulate rotary boring and also cause steering.

In one embodiment, slugs 10 are fired in sequence to create the effects of rotary boring and maximize boring efficiency. Here, pulsejets 3101, 3103, 3105, 3107 and 3109 around the periphery of the borehead 3000 are fired in this order creating slugs 10, shown at various distances from the pulsejets. A controller (1020 of FIGS. 2*a*-2*f*) activates thermal units (3510, 3530 of FIGS. 2*a*-2*f*) at the proper times to create the sequence as shown. This simulates the effect of a rotary drilling in the direction by the arrows marked "A".

Steering is more fully discussed in "Steerable Boring Device" incorporated by reference in the Cross Reference to Related applications above.

In another embodiment of the present invention, the boring subsystem may be used above ground to cut or shape materials. It works best with materials which become brittle when cooled.

The present invention provides a cryogenic pulse jet source which cuts through hardened materials much more quickly than a steady flow cryogenic jet.

The present invention provides a cryogenic pulse jet that does not require valves which tend to freeze and malfunction. This results in a more reliable system.

The present invention does not require the use of high pressure liquids as do other prior art devices, therefore resulting in a simpler, less bulky system.

The present invention employs the ambient energy of the ground as a heat source to provide a temperature differential used to fracture hard materials in the ground.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A cryogenic rapid boring system for rapidly boring a hole in a material comprising:

a) a borehead having at least one pulsejet with a proximal end and a distal end located adjacent to said material intended to be bored;

b) a cryogen supply unit for providing a cryogenic liquid to fill the pulsejet;

c) a pulsejet having an expansion section located adjacent to the distal end;

d) a tube having a freeze section located just proximal to the expansion section;

e) at least one thermal unit capable of freezing cryogenic liquid into a plug and capable of melting the frozen plug located adjacent to the freeze section;

f) at least one thermal unit capable of vaporizing the cryogenic liquid into a gas, and capable of cooling the expansion section;

g) a controller coupled to the cryogen supply unit, the thermal units, and operating to activate:

i. the cryogen supply unit to fill the pulsejet with the cryogenic liquid;

ii. thermal units to freeze the plug at the freeze section;

iii. thermal units to rapidly vaporize the cryogenic liquid, into the gas just distal to the frozen plug thereby causing the gas to force cryogenic liquid distal to the gas out of the distal end of pulsejet at a high velocity impacting said material thereby firing the pulsejet;

iv. the thermal units to melt the frozen plug; and v. the thermal units to cool the expansion section.

2. The cryogenic rapid boring system of claim 1, wherein there are multiple pulsejets in the borehead.

3. The cryogenic rapid boring system of claim 1, wherein the thermal units are electrically coupled and use the Peltier effect to heat and cool the pulsejet.

4. The cryogenic rapid boring system of claim 1, wherein there are a plurality of the thermal units in the freeze section operating to rapidly freeze the cryogenic liquid into the plug and operating to rapidly melt the plug when activated.

5. The cryogenic rapid boring system of claim 1, wherein there are a plurality of the thermal units in the expansion section operating to rapidly vaporize the cryogenic liquid into the gas and operating to rapidly cool the expansion section when activated.

6. The cryogenic rapid boring system of claim 2, wherein the controller is adapted to operate to fire the pulsejets in a predetermined sequence to optimize boring.

7. The cryogenic rapid boring system of claim 2, wherein the controller is adapted to operate to fire the pulsejets in a predetermined sequence to simulate rotary boring.

8. The cryogenic rapid boring system of claim 1, wherein the controller is adapted to operate to adjust the intensity of the slug fired from the system.

9. The cryogenic rapid boring system of claim 1, wherein the controller is adapted to adjust the size of the slug fired from the system.

10. A method of boring through solid material with a cryogenic liquid comprising the steps of:

a. providing a borehead having at least one pulsejet capable of holding a liquid, having a distal end and an opposite proximal end, the distal end being positioned near, and pointing toward said material;

b. providing cryogenic liquid to the proximal end of the pulsejet;

c. freezing the cryogenic liquid near the distal end of the pulsejet into a plug at a location such that there is cryogenic liquid distal to the plug;

d. rapidly heating the cryogenic liquid distal to the plug causing it the cryogenic liquid to be converted into rapidly-expanding gas rapidly forcing the cryogenic liquid distal to the gas out of the distal end of the pulsejet as a slug which impacts said material;

e. repeating steps "b"-"d" to cause multiple slugs to be forced out of the pulsejet thereby boring a hole through said material.

11. The method of claim 10 wherein there are a plurality of the pulsejets in the borehead.

12. The method of claim 11 wherein the pulsejets are fired in sequence to simulate rotary drilling.

13. The method of claim 10 wherein thermal units are electrically coupled operating under the Peltier effect to heat and cool the pulsejet.

14. The method of claim 10 wherein a plurality of thermal units are employed in a freeze section operating to rapidly freeze the cryogenic liquid into the plug and operating to rapidly melt the plug.

15. The method of claim 10 wherein a plurality of thermal units are employed in an expansion section operating to rapidly vaporize the cryogenic liquid into the gas and operating to rapidly cool the expansion section when activated.

16. The method of claim 10 wherein a plurality of pulsejets are operated in a predetermined sequence to optimize boring.

17. The method of claim 10 wherein a plurality of pulsejets are operated in a predetermined sequence to simulate rotary boring.

18. The method of claim 10 wherein the step of rapidly heating comprises the step of:

applying a predetermined amount of power to thermal units so as to produce a predetermined firing intensity of the slug from the pulsejet.

19. The method of claim 10 wherein the step of freezing comprises the step of:

activating thermal units at a predetermined time so as to adjust the size of the slug created and fired from the pulsejet.

* * * * *